US011885214B2

(12) United States Patent
Samuel et al.

(10) Patent No.: US 11,885,214 B2
(45) Date of Patent: Jan. 30, 2024

(54) CASING WEAR AND PIPE DEFECT DETERMINATION USING DIGITAL IMAGES

(71) Applicant: Landmark Graphics Corporation, Houston, TX (US)

(72) Inventors: Robello Samuel, Cypress, TX (US); Rishi Adari, Katy, TX (US)

(73) Assignee: Landmark Graphics Corporation, Inc., Houston, TX (US)

( * ) Notice: Subject to any disclaimer, the term of this patent is extended or adjusted under 35 U.S.C. 154(b) by 7 days.

(21) Appl. No.: 17/361,441

(22) Filed: Jun. 29, 2021

(65) Prior Publication Data

US 2022/0412205 A1 Dec. 29, 2022

(51) Int. Cl.

| | |
|---|---|
| ***E21B 44/00*** | (2006.01) |
| ***E21B 47/002*** | (2012.01) |
| ***E21B 47/04*** | (2012.01) |
| ***E21B 44/02*** | (2006.01) |

(52) U.S. Cl.

CPC ..... *E21B 47/002* (2020.05); *E21B 44/00* (2013.01); *E21B 44/02* (2013.01); *E21B 47/04* (2013.01)

(58) Field of Classification Search

CPC ..... E21B 47/00; E21B 47/002; E21B 47/04; E21B 44/00; E21B 44/02

See application file for complete search history.

(56) References Cited

U.S. PATENT DOCUMENTS

| | | | | |
|---|---|---|---|---|
| 2006/0111852 | A1* | 5/2006 | Papadimitriou | G05B 19/41875 702/35 |
| 2016/0342916 | A1* | 11/2016 | Arceneaux | E21B 47/13 |
| 2017/0175515 | A1 | 6/2017 | Gonzales et al. | |
| 2017/0191361 | A1 | 7/2017 | Khalaj Amineh et al. | |
| 2017/0284186 | A1* | 10/2017 | Samuel | E21B 47/07 |
| 2018/0073347 | A1 | 3/2018 | Aniket et al. | |
| 2018/0216412 | A1* | 8/2018 | Samuel | E21B 47/00 |
| 2019/0104252 | A1* | 4/2019 | Starr | H04N 5/2253 |
| 2020/0141225 | A1* | 5/2020 | Aniket | E21B 41/0092 |
| 2020/0157893 | A1* | 5/2020 | Jorud | E21B 19/165 |
| 2022/0178674 | A1* | 6/2022 | Eames | F17D 5/02 |

FOREIGN PATENT DOCUMENTS

| | | | |
|---|---|---|---|
| EP | 2971491 | B1 | 3/2018 |
| WO | 2018231248 | A1 | 12/2018 |

* cited by examiner

*Primary Examiner* — Taras P Bemko

(74) *Attorney, Agent, or Firm* — Michael Jenney; Parker Justiss, P.C.

(57) ABSTRACT

The disclosure presents solutions for determining a casing wear parameter. Image collecting or capturing devices can be used to capture visual frames of a section of drilling pipe during a trip out operation. The visual frames can be oriented to how the drilling pipe was oriented within the borehole during a drilling operation. The visual frames can be analyzed for wear, e.g., surface changes, of the drilling pipe. The surface changes can be classified as to the type, depth, volume, length, shape, and other characteristics. The section of drilling pipe can be correlated to a depth range where the drilling pipe was located during drilling operations. The surface changes, with the depth range, can be correlated to an estimated casing wear to generate the casing wear parameter. An analysis of multiple sections of drilling pipe can be used to improve the locating of sections of casing where wear is likely.

25 Claims, 8 Drawing Sheets

CASING WEAR AND PIPE DEFECT DETERMINATION USING DIGITAL IMAGES

TECHNICAL FIELD

This application is directed, in general, to improving borehole drilling and, more specifically, to analyzing casing wear resulting from drilling operations.

BACKGROUND

In developing a borehole, such as when drilling operations are being conducted, the drill string, e.g., pipe, can rub or produce friction against casing located downhole the borehole. In addition, mud, drilling fluids, hydrocarbon fluids, cuttings, and other downhole material can cause a wearing of casing material thereby reducing the casing thickness. The overall casing wear can reduce the effective lifespan of the casing section, can increase the potential for a borehole collapse, or other negative borehole effects. Being able to better estimate the wear on downhole casing would be beneficial.

SUMMARY

In one aspect, a method is disclosed. In one embodiment, the method includes (1) receiving input parameters of at least one visual frame of a first drilling pipe segment, wherein the first drilling pipe segment is being removed from a borehole, (2) determining a depth parameter corresponding to a location of the first drilling pipe segment relative to other drilling pipe segments, (3) analyzing the at least one visual frame to determine a surface change of a surface of the first drilling pipe segment, and (4) correlating the surface change to a casing wear parameter of a section of casing located downhole in the borehole, wherein the section of casing is correlated to the depth parameter.

In a second aspect, a system is disclosed. In one embodiment, the system includes (1) a data transceiver, capable of receiving input parameters from one or more image devices located at a surface location of a borehole undergoing drilling operations, wherein the one or more image devices are capable to capture at least one visual frame of a drill string, the drill string is coupled to a surface equipment of the borehole, and the drill string is capable of being inserted into the borehole, (2) a result transceiver, capable of communicating a casing wear parameter, and (3) a casing wear processor, capable of using at least one of the input parameters to generate the casing wear parameter, wherein each visual frame is analyzed for a surface change in a surface of the drill string, and the casing wear parameter is correlated to the surface change and a depth in the borehole of the drill string during a previous drilling operation.

In a third aspect, a computer program product having a series of operating instructions stored on a non-transitory computer-readable medium that directs a data processing apparatus when executed thereby to perform operations is disclosed. In one embodiment, the operations include (1) receiving input parameters of at least one visual frame of a first drilling pipe segment, wherein the first drilling pipe segment is being removed from a borehole, (2) determining a depth parameter corresponding to a location of the first drilling pipe segment relative to other drilling pipe segments, (3) analyzing the at least one visual frame to determine a surface change of a surface of the first drilling pipe segment, and (4) correlating the surface change to a casing wear parameter of a section of casing located downhole in the borehole, wherein the section of casing is correlated to the depth parameter.

BRIEF DESCRIPTION

Reference is now made to the following descriptions taken in conjunction with the accompanying drawings, in which.

DETAILED DESCRIPTION

Figure 1:
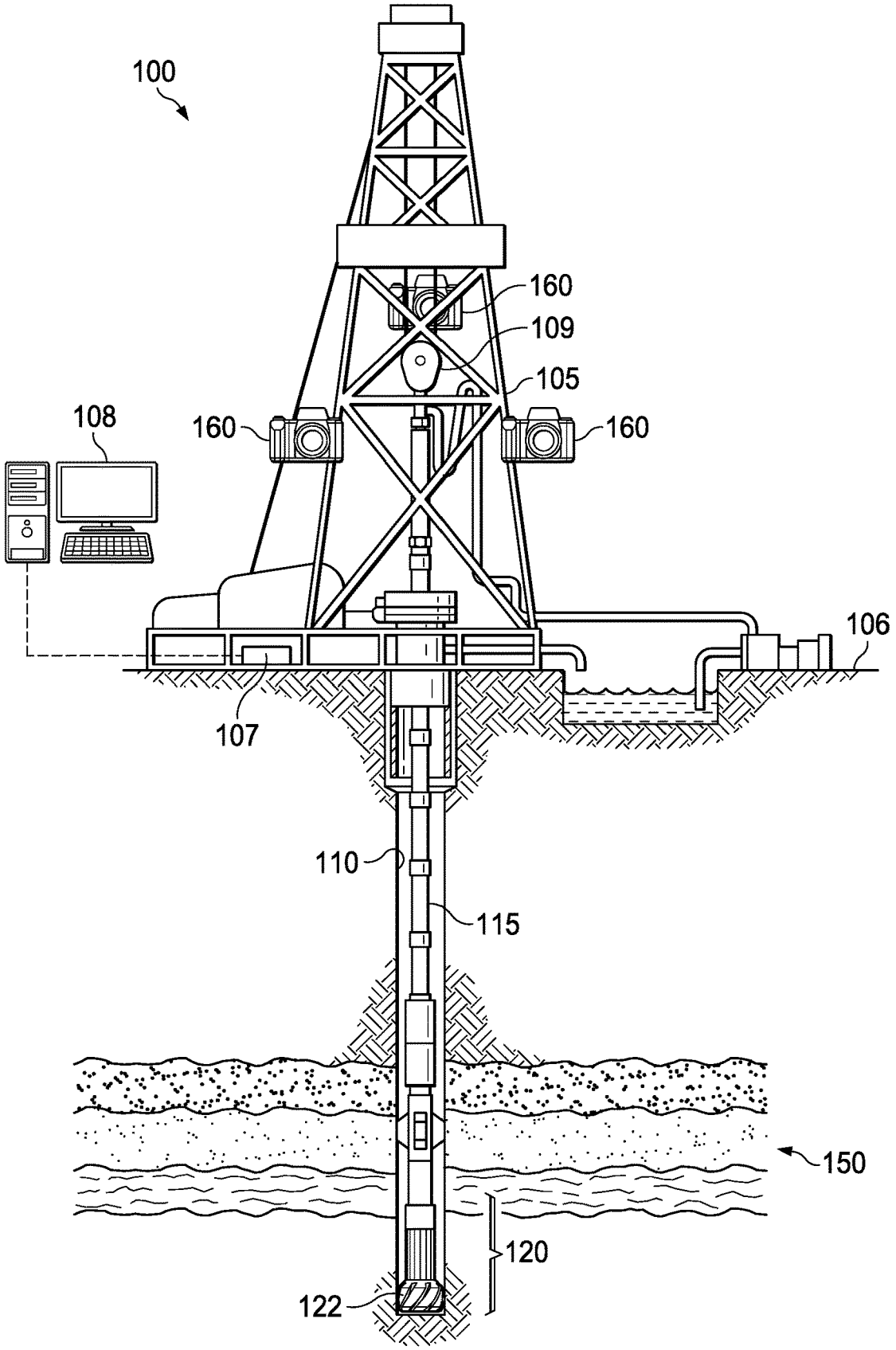
FIG. 1 is an illustration of a diagram of an example drilling borehole system using a visual casing wear system.

When developing a borehole, multiple types of borehole operations can be employed, such as drilling, trip in of a drill string, trip out of a drill string (i.e., drill pipe operations), extraction, and other borehole operations. Various fluids can be pumped into a borehole, such as a mud or drilling fluid, and fluids can be pumped out of the borehole, such as hydrocarbon fluids. The borehole operations can result in a build-up of material within the borehole, such as cuttings. One or more of these borehole operations, fluids, and materials can result in some casing wear of a casing located downhole the borehole. Environmental factors, such as downhole pressure and downhole temperature, can affect the amount or rate of casing wear overtime. Boreholes can be for hydrocarbon production purposes, scientific purposes, research purposes, or other borehole purposes.

For example, various types of drilling tools can be used to form boreholes in associated downhole formations. Drilling tools can include, but is not limited to, rotary drill bits, reamers, core bits, under reamers, hole openers, or stabilizers, and can be collectively referred to as a bottom hole assembly (BHA). The BHA can include additional components, such as sensors, power storage devices, communication devices, and other components suitable for downhole operations.

As the borehole is drilled, the BHA, when contacting the casing, can result in wear on the casing. The strength of the casing can be reduced or degraded due to the wear. Overtime, the casing wear can be sufficient to require a remediation operation to be conducted, for example, adjusting the drilling operation plan, replacing the section of casing with the wear, or other remediation operations. If a need for a remediation operation is not identified with sufficient notice to a user or a well site controller, the integrity of the borehole can be degraded, with an extreme result of a potential for a borehole collapse.

The increasing complexities of borehole geometry can imply an increasing potential of damage to the casing and increasing casing wear. Although the locations of casing wear can be difficult to predict, the quantification of the casing wear can be important to achieve a reduced cost per foot of drilling of a borehole and a more reliable prediction on potential casing failure. Conventionally, casing wear can be estimated using wireline logs, which can be an expensive operation for the borehole operations. A lower cost operation to estimate downhole casing wear would be beneficial.

This disclosure presents solutions to utilize the wear on the drilling pipe as a proxy to identify the location and quantification of the casing wear occurring downhole. The solutions can be methods and processes. The amount of wear on the casing can be related to the surface texture changes on the drilling pipe, for example, as the drilling pipes are tripped out of the borehole an analysis of the surface changes can be conducted. A hybrid approach can be used that combines physics, visual data, and historical visual data, where the historical visual data was obtained from a previous run of the operations in the borehole. The solutions can be used to estimate a life of the casing, a life of the drilling pipe, a life of the BHA, or an overall well integrity of the borehole. The solutions can be used to quantify the integrity of the borehole barriers.

Casing wear and defect detection, as well as defect classification, can be detected using digital images collected or captured using, for example, rig cameras, lasers, light detection and ranging (Lidar) systems, and other video or image capturing technologies. The digital images, e.g., visual frames, can be used as input parameters and be processed as the drilling pipe is tripped out and the resulting analysis of those images can be utilized to estimate the casing wear parameters, such as the depth parameter, type of wear, severity of the wear (e.g., quantification of the wear), the classification of the wear, and other parameters. In some aspects, the visual frames, e.g., video frames or image frames, of a drilling pipe can be compared to the visual frames of the same drilling pipe when it was inserted into the borehole, where a difference can be identified for further analysis to determine if that difference was caused by casing wear or caused by a downhole condition that would also affect the casing.

The visual-based approach can quantify the surface defects of the drilling pipe, such as a reduction in the surface or polish nature of the drilling pipe, grooves or scratch patterns, pitting, gouging, spiraling, or other surface defects. A drilling operation connection can be established between the input parameters and a depth at which drilling operations occurred. In some aspects, the drilling operation connection can be compared to one or more casing wear models. The casing wear models can provide relevant information for the operational problem in a depth domain.

The visual-based approach can utilize various models to determine changes to the drilling pipe surface. In some aspects, the models can be autoregressive (AR) models to define the drilling pipe surface texture features utilizing the linear dependencies of pixels. In some aspects, a one-dimensional model can be used with a surface threshold parameter to define the difference between a rough surface and a smooth surface. In some aspects, machine learning techniques can be used for surface texture defect identification modeling, where the identified changes can be classified as true defects or false positives.

In some aspects, the surface textures can be generated using simulated images available in the public domain. In some aspects, machine learning techniques can utilize one or more of neural networks, machine learning systems, deep neural network systems, fuzzy logic systems, K-means clustering, or other machine learning techniques. The machine learning techniques can be combined with a physics-based model to quantify the defect or the amount of casing wear at the identified depth location.

In some aspects, a machine learning system or a deep neural network system can be utilized that can receive the input parameters, such as the visual frames, and determine the amount of casing wear at various depths within the borehole. Casing wear models can be stored in the machine learning system or deep neural network system. As new information or models are communicated to the machine learning system or deep neural network system, the accuracy of the outputs can increase, thereby reducing the uncertainty of the casing wear at various depths of the borehole. For example, feedback from the output parameter can be used to train the machine learning or the deep neural network system. In some aspects, the methods and processes described herein can be utilized to analyze historical data to improve the accuracy of the machine learning system or deep neural network system.

In some aspects, the methods and processes described herein can be encapsulated as a function or a series of functions, for example, one or more microservices, which can be accessed by the drilling operation, a well site controller, a rig controller, or other borehole system. For example, a first function, e.g., microservice, can be utilized to capture and process received visual frames. In some aspects, the processing can include decomposing the information into axial, radial, and surface roughness factors. A second function can be utilized to determine a drilling pipe change using video or image frame. In some aspects, a comparison can be made to a video or image frame for the specific drilling pipe taken at an earlier time, such as when the drilling pipe was inserted into the borehole. A third function can be utilized to classify a detected change, such as a surface defect, or a change due to casing wear, and other functions can add other components, such as identifying the depth where the casing wear occurred and the severity of the casing wear. The functions can be combined, separated, or partially combined in an implementation.

In some aspects, the drilling operations can be directed by a drilling controller, a rig controller, a well site controller, a bottom hole assembly (BHA), a proximate computing system, an edge computing system, or a distant computing system, for example, a cloud environment, a data center, a server, a laptop, a smartphone, or other computing systems. In some aspects, a portion of the disclosed methods and processes can be performed by downhole tools, such as by a drilling assembly or a reservoir description tool.

Turning now to the figures, FIG. 1 is an illustration of a diagram of an example drilling borehole system 100 using a visual casing wear system. Drilling borehole system 100 can be a drilling system, a logging while drilling (LWD) system, a measuring while drilling (MWD) system, a seismic while drilling (SWD) system, a telemetry while drilling (TWD) system, and other hydrocarbon well systems, such as a relief well or an intercept well. Drilling borehole system 100 includes a derrick 105, a well site controller 107, and a computing system 108. Well site controller 107 includes a processor and a memory and is configured to direct operation of drilling borehole system 100. In some aspects, well site controller 107 can be a drilling controller. Derrick 105 is located at a surface 106.

Derrick 105 includes a traveling block 109 that includes a drill string hook. Traveling block 109 includes surface sensors to collect data on hook-load and torque experienced at traveling block 109. Extending below derrick 105 is a borehole 110, e.g., an active borehole, with downhole tools 120 at the end of a drill string 115, where drill string 115 is coupled to surface equipment. Downhole tools 120 can include various downhole tools and BHA, such as drilling bit 122. Other components of downhole tools 120 can be present, such as a local power supply (e.g., generators, batteries, or capacitors), telemetry systems, downhole sensors, transceivers, and control systems. The various sensors can be one or more of one or more downhole sensors or one or more surface sensors, that can provide one or more collected or measured parameters to other systems. The collected or measured parameters can be pressure parameters, temperature parameters, or composition parameters of the mud at specified locations within borehole 110. The collected or measured parameters can be casing wear parameters or drill string wear parameters at specified locations within borehole 110. Other collected and measured parameters can be collected as well. The collected or measured parameters can be utilized as input parameters to the disclosed processes and methods.

Borehole 110 is surrounded by subterranean formation 150. Well site controller 107 or computing system 108 which can be communicatively coupled to well site controller 107, can be utilized to communicate with downhole tools 120, such as sending and receiving telemetry, data, drilling sensor data, instructions, and other information, including collected or measured parameters, cuttings and other material parameters, bed heights, weighting parameters, location within the borehole, a cuttings density, a cuttings load, a cuttings shape, a cuttings size, a deviation, a drill string rotation rate, a drill string size, a flow regime, a hole size, a mud density, a mud rheology, a mud velocity, a pipe eccentricity, and other input parameters.

Computing system 108 can be proximate well site controller 107 or be distant, such as in a cloud environment, a data center, a lab, or a corporate office. Computing system 108 can be a laptop, smartphone, PDA, server, desktop computer, cloud computing system, other computing systems, or a combination thereof, that are operable to perform the processes and methods described herein. Well site operators, engineers, and other personnel can send and receive data, instructions, measurements, and other information by various conventional means with computing system 108 or well site controller 107.

In some aspects, a casing wear processor can be part of well site controller 107 or computing system 108. The casing wear processor can receive the various input parameters, such as from a data source, previous survey data, laboratory test data, real-time or near real-time data received from sensors downhole or at a surface location, rig cameras 160, and perform the methods and processes disclosed herein. In some aspects, rig cameras 160 can utilize other technologies, such as lasers, Lidar, and other image collecting or capturing technologies. The results of the analysis can be communicated to a drilling operations system, a drilling controller, a geo-steering system, or other well site system or user where the results can be used as inputs to direct further borehole operations. In some aspects, computing system 108 can be located with downhole tools 120 and the computations can be completed at the downhole location. The results can be communicated to a drilling system, a drilling controller, or to a drilling operation system downhole or at a surface location. The received results, such as a casing wear parameter, can be used to implement remediation operations.

FIG. 1 depicts an onshore operation. Those skilled in the art will understand that the disclosure is equally well suited for use in offshore operations. FIG. 1 depicts a specific borehole configuration, those skilled in the art will understand that the disclosure is equally well suited for use in boreholes having other orientations including vertical boreholes, horizontal boreholes, slanted boreholes, multilateral boreholes, and other borehole types.

Figure 2A:
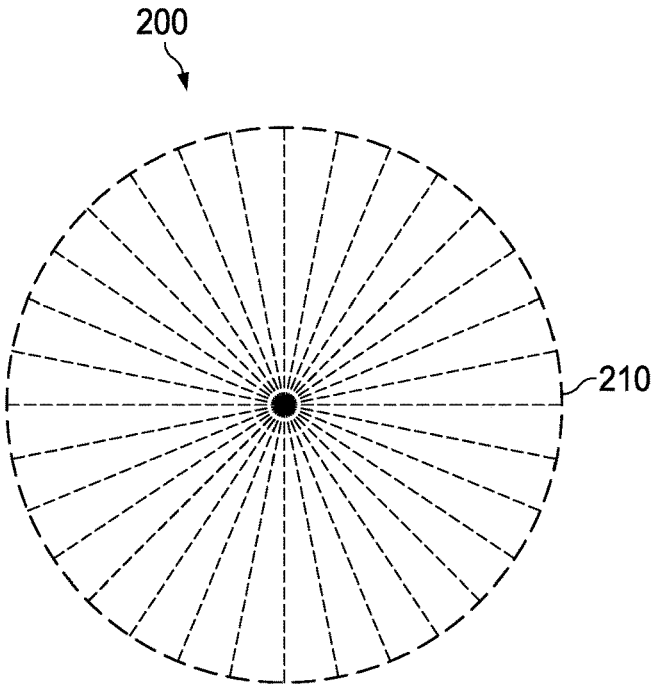
FIG. 2A and FIG. 2B are illustrations of diagrams of an example radial and axial decomposition of a camera view.
Figure 2B:
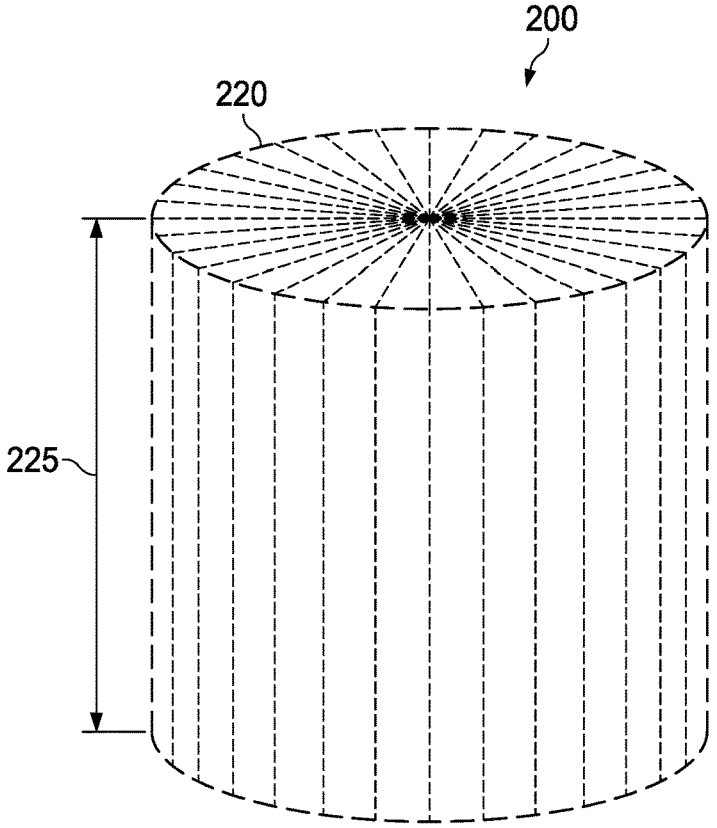

FIG. 2A and FIG. 2B are illustrations of diagrams of an example radial and axial decomposition 200 of a camera view. As a drill string is tripped in or tripped out of a borehole, one or more image capturing or collecting devices at the surface can capture visual frames, e.g., video frames or image frames, of the surface of the drill string. The visual frames can be decomposed to enable further analysis of surface changes. Radial and axial decomposition 200 shows a top-down view 210 of a drill pipe. The radial lines indicate a demonstration of how the collected visual frames can be analyzed using an arc of the circumference of the drill pipe, e.g., a slice. For example, the arc can be 1/72 of the circumference. Other arc values can be used, such as 1/20 of the circumference or 1/120 of the circumference.

Radial and axial decomposition 200 shows a side view 220 of the drill pipe shows that demonstrates the radial lines extending the length of the drill pipe, e.g., an axial decomposition. The length of the drill pipe is demonstrated by arrow 225, and is shown as 10 feet in this example. Other drill pipe lengths can be used. Each slice of the surface of the drill pipe can be analyzed for surface changes. Neighboring slices can be analyzed as well, such as to determine depth and length of surface defects to determine a total volume of the defect.

Figure 3A:
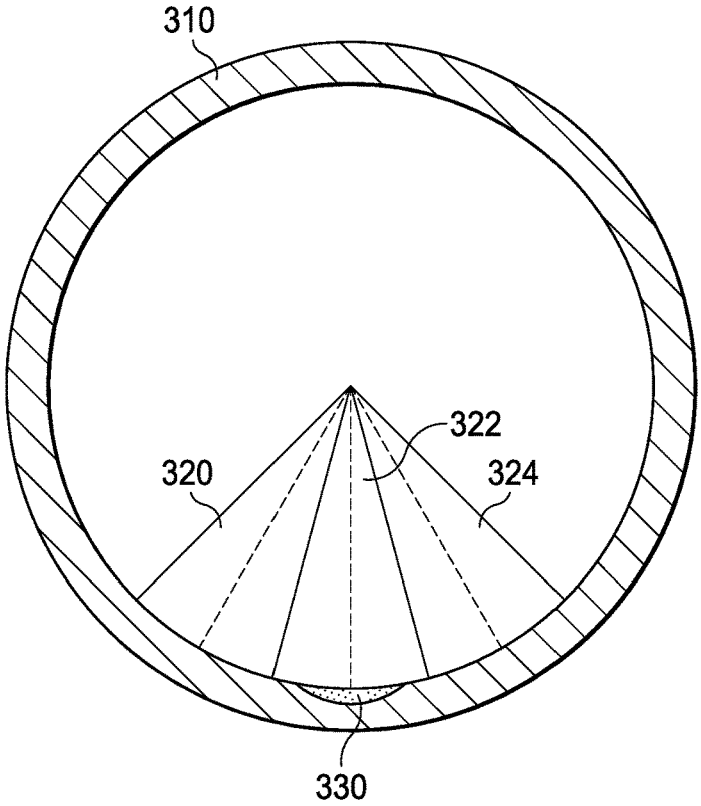
FIG. 3A and FIG. 3B are illustrations of diagrams of an example drilling pipe defect identification.
Figure 3B:
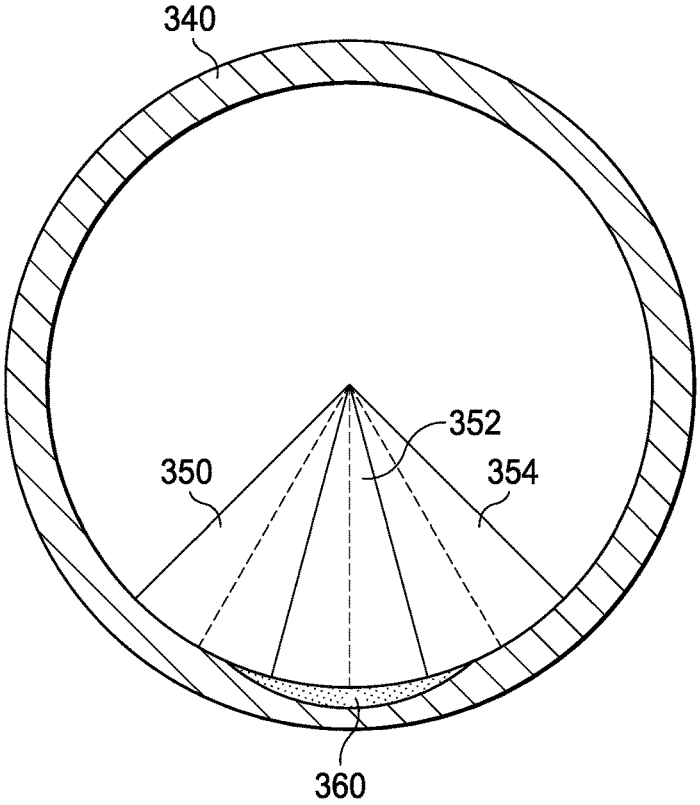

FIGS. 3A and 3B are illustrations of diagrams of an example drilling pipe defect identification for a drill pipe 310 and a drill pipe 340. The defect identification demonstrates an example of how neighboring sections of a visual frame decomposition can be examined to improve classification of wear types of the drill pipe surface. Drill pipe 310 demonstrates three visual frame sections shown, a section 320, a section 322, a section 324. Radial lines have been labeled A through G which can be used by the methods and processes to analyze the visual frames for surface changes. Surface change 330 is shown on drill pipe 310. Surface change 330 is a wearing away of part of the surface of the drill pipe.

Neighboring sections can be analyzed to improve the classification of wear types, and to improve the quantification of the surface changes. In drill pipe 340, which has the same visual frame sections as drill pipe 310, labeled as a section 350, a section 352, and a section 354, a surface change 360 has been identified. Surface change 360 extends beyond section 352 to section 350 and section 354. The larger surface change 360, as compared to surface change 330, indicates a more significant wear point, and therefore an increase in likelihood of casing wear at the corresponding depth within the borehole, where drill pipe 340 was located during drilling operations.

Figure 4:
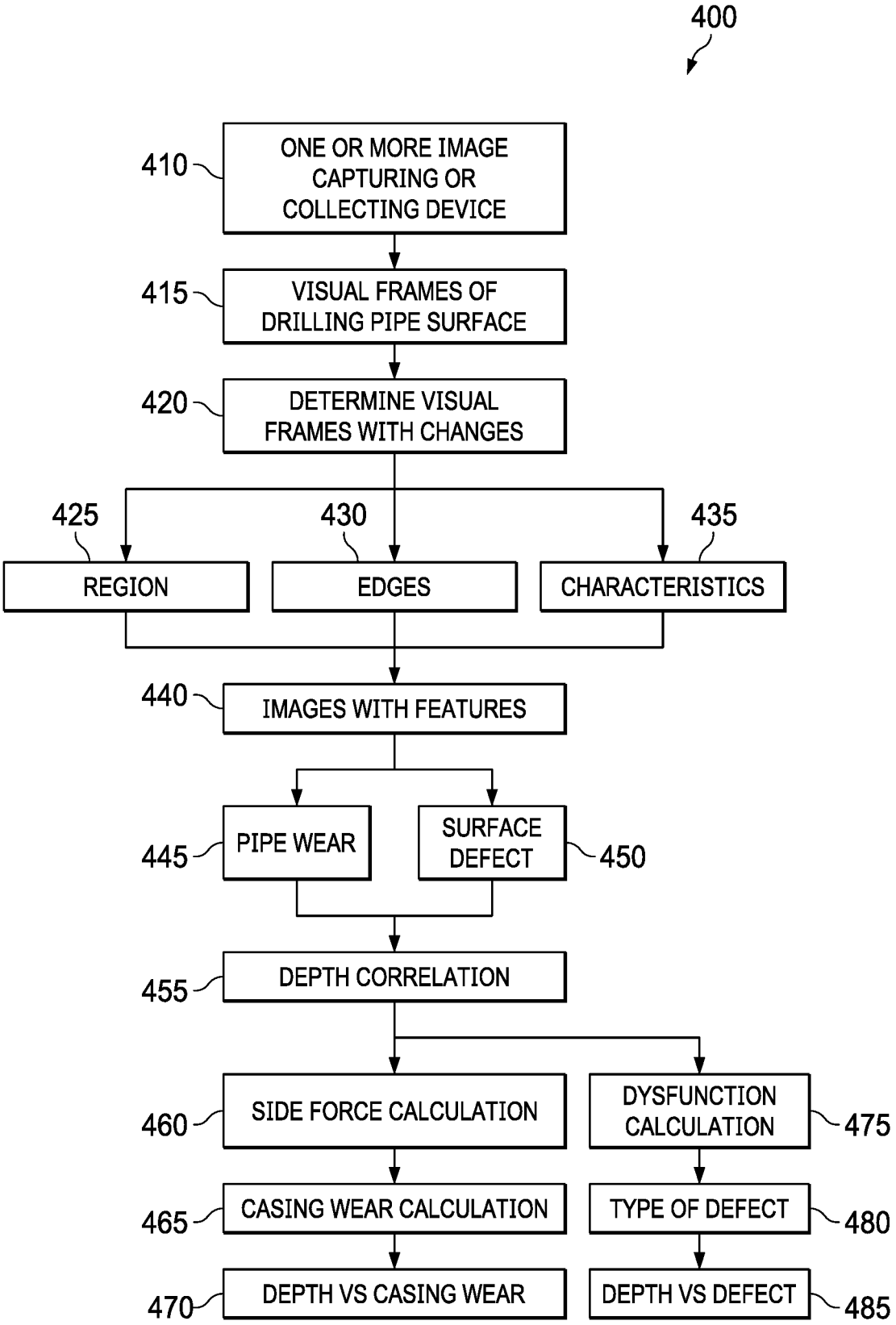
FIG. 4 is an illustration of a diagram of example functional flow to identify casing wear at a depth.

FIG. 4 is an illustration of a diagram of an example functional flow 400 to identify casing wear at an identified depth. Functional flow 400 starts at a flow 410 where one or more image collecting or capturing devices, such as rig cameras, lasers, Lidars, and other technologies, can collect or capture visual frames of a section of drilling pipe, e.g., one segment of pipe. In a previous functional flow, the image collecting or capturing devices can collect visual frames of the drilling pipe as it is inserted into the borehole (e.g., a previous drilling operation), where these trip in visual frames can be compared to trip out visual frames as part of the analysis of the drilling pipe wear. The image collecting or capturing devices can be movables or stationery. For example, in some aspects, one or two image collecting or capturing devices can be movable to collect visual images of the full circumference of the drilling pipe. In some aspects, multiple image collecting or capturing devices can be used that are stationary to collect 360 degrees of the circumference of the drilling pipe.

In a flow 415, the visual frames that have been collected or captured can be pre-processed, such as using a machine learning system, or other image pre-processing techniques. In a flow 420, the visual frames can be analyzed to determine the visual frames, or slices of the drilling pipe circumference, that have surface changes. In a flow 425, the region of the drilling pipe, such as a specific slice, relative to a selected origin point, can be identified as the region with the maximum wear volume. In a flow 430, the edges of the wear area can be determined, such as combining slices if a wear extends across multiple slices of the circumference. In a flow 435, the wear characteristics can be identified, for example, roughness, pitting, rubbing, grooving, and in what direction or shape, such as vertical wear, horizontal wear, gouging, spiraling, and other wear directions or shapes. Flow 425, flow 430, and flow 435 can be processed serially, in parallel, with overlap, or a combination thereof.

In a flow 440, the outputs for flow 425, flow 430, and flow 435 can be combined to generate an analysis of the wear of the section of the drilling pipe. A wear classification, e.g., a wear type, can be derived from the outputs. In a flow 445, the wear classification can be compared to models to determine if the wear is a material wear of the pipe, such as metal wear. In a flow 450, the wear classification can be compared against models to determine if the wear is due to surface defects. Flow 445 and flow 450 can be processed serially, in parallel, with overlap, or a combination thereof.

In a flow 455, the outputs from flow 445 and flow 450 can be utilized, with other input parameters, to correlate a depth of the section of drilling pipe during drilling operations to a section of casing or a section of open borehole. The depth can be an approximate depth or a depth range as the drilling pipe is moved up and down within the borehole during the drilling operation stage. Using an analyzation of more than one section of drilling pipe, the depth range can be narrowed as to where the wearing had occurred. For example, knowing which sections of drilling pipe were located proximate a specific section of casing, and then analyzing those sections of the drilling pipe for similar wear classifications and intensities can assist in narrowing the depth range and hence the range of casings that were affected. The orientation of the identified wear on the section of drilling pipe can be orientated to the geometry of the borehole at that depth to assist in determining the side of the casing experiencing wear, for example, in a horizontal section, a top side versus a bottom side of the borehole.

In a flow 460, a side force calculation can be made to determine the amount of force the section of drilling pipe likely exerted on the casing. A casing wear can be estimated from this force. In a flow 465, a casing wear calculation can be made to generate a casing wear parameter. In a flow 470, the depth can be correlated with the casing wear to adjust the casing wear parameter to include the depth range of the casing section affected.

In a flow 475, dysfunction calculation can be made to generate a defect type. In a flow 480, the defect type can be classified as a wear classification. In a flow 485, the depth range can be correlated to the wear classification. A determination can be made on the casing section or casing sections that can be affected by the wear, or if the wear should be not used in the analysis due to other defects in the drilling pipe or defects caused by other than downhole drilling operations. Flow 460 and flow 475, and the subsequent flows, can be processed serially, in parallel, with overlap, or a combination thereof. The casing wear parameter can be communicated to a system for further action, such as a user, a drilling controller, a rig controller, a well site controller, or other borehole systems located proximate the borehole or distant from the borehole.

Figure 5:
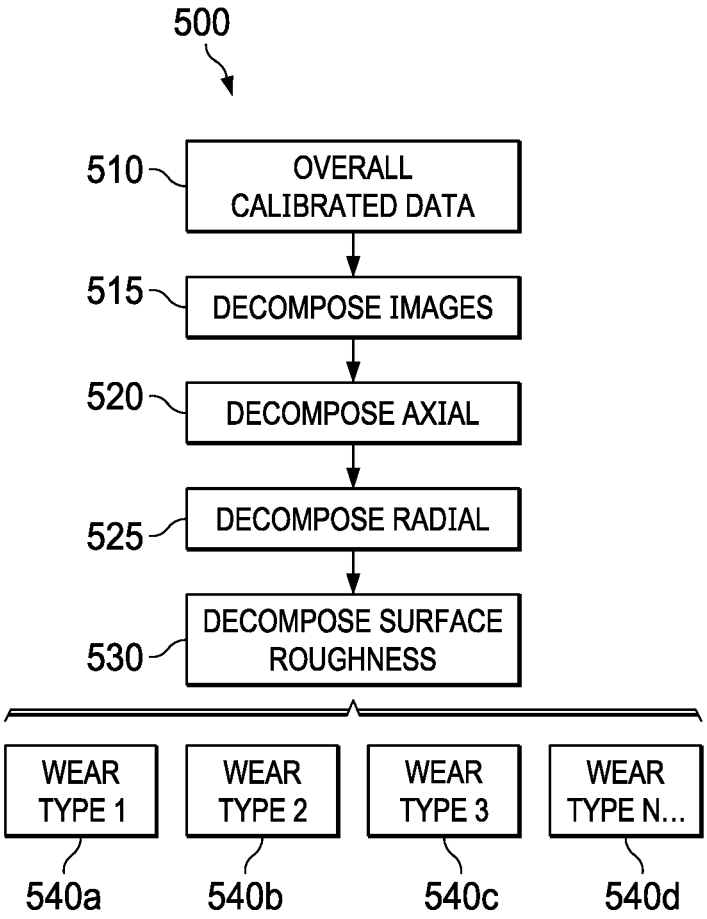
FIG. 5 is an illustration of a diagram of an example functional flow to classify wear types.

FIG. 5 is an illustration of a diagram of an example functional flow 500 to classify wear types. Functional flow 500 can be part of a system to determine a casing wear parameter. At a starting flow 510, overall calibrated data can be received. The calibrated data can be the input parameters, such as the visual frames, an arc decomposition parameter (for example, 1/72, 1/120 of the circumference, or other arc decomposition parameter values), a length of the drilling pipe parameter, and other input parameters. In a flow 515, the visual frames can be aligned and decomposed. For example, if more than one image collecting or capturing device is available, or if a movable image collecting or capturing device collects more than one visual frame, each of the collected visual frames can be aligned, overlapped, or otherwise positioned to form as complete a 360-degree visual of the drilling pipe as possible.

In a flow 520, each visual frame can be decomposed axially. The visual frames can be selected that relate to a selected segment of the drilling pipe. Other drilling pipe segments can be analyzed in a different iteration of the processes and methods. In a flow 525, each visual frame can be radially decomposed using the decomposition parameter. The decomposed visual frame forms a logical section of the drilling pipe surface that can be analyzed for surface changes. In a flow 530, each section of each visual frame can be analyzed for surface changes, such as a change in surface roughness, grooves, scratches, pitting, chemical wearing, and other changes. In a flow 540*a*, a flow 540*b*, a flow 540*c*, a flow 540*d*, the identified surface changes from flow 530 can be classified by the type of wear. Wear can be classified in different ways, such as scratching, pitting, rubbing, impacting, grooving, gouging, and other types of wear. The type of wear can then be used in the analysis to generate the casing wear parameter. For example, a chemical type of wear can be weighted lower than a groove type of wear when correlating to the casing wear parameter.

Figure 6:
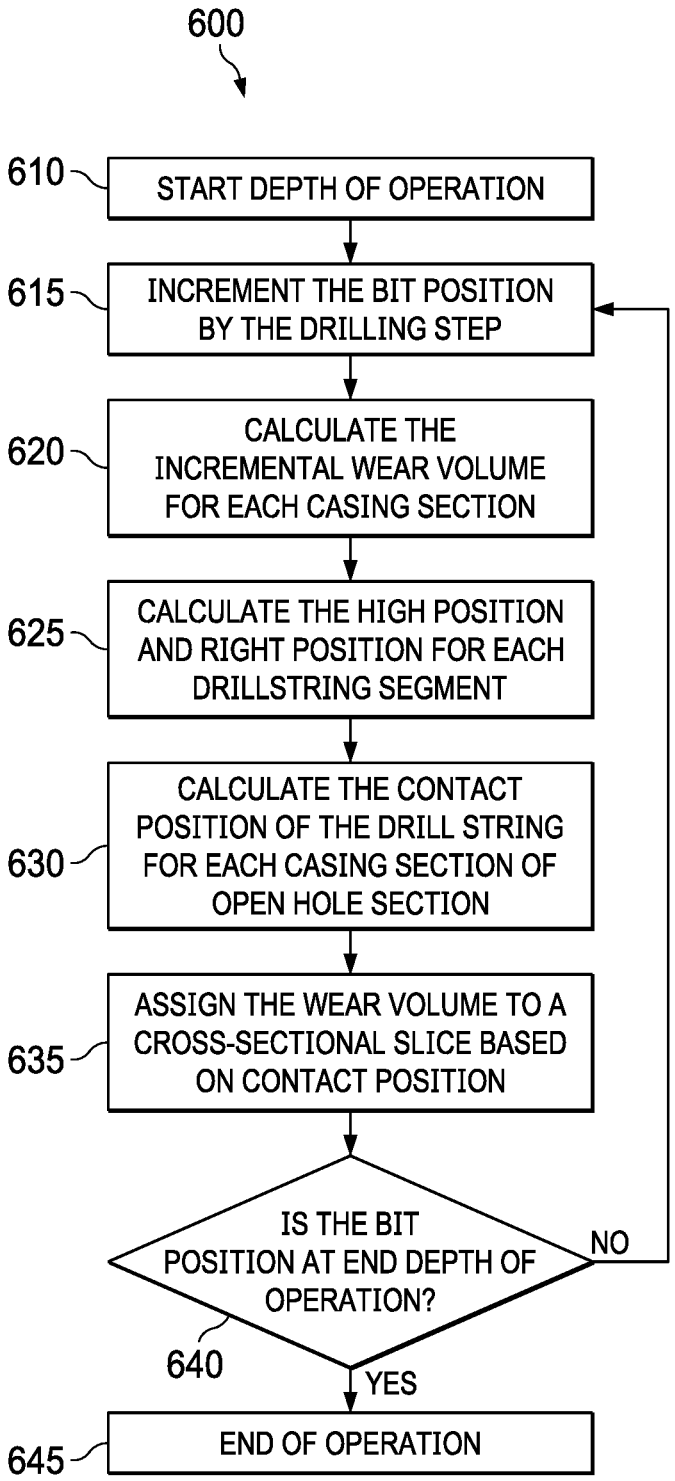
FIG. 6 is an illustration of a flow diagram of an example method to analyze a drilling pipe segment.

FIG. 6 is an illustration of a flow diagram of an example method 600 to analyze a drilling pipe segment. Method 600 starts at a step 610 and proceeds to a step 615. In step 615, the drilling bit position for a section of drilling pipe can be correlated to the section of drilling pipe, e.g., where in the borehole the section of drilling pipe was located during the last drilling job. In a step 620, the section of drilling pipe can be analyzed using visual frames of the surface of the drilling pipe to generate an incremental wear volume, e.g., surface changes, for the section of drilling pipe. The wear type can be classified.

In a step 625, the surface changes identified in step 620 can be oriented to the geometry of the drilling pipe as it was positioned in the borehole. For example, the high position and right position, e.g., selecting an origin point, can be identified for each visual frame, and subsequently, a relative position of the surface change can be localized. In a step 630, the relative position of the surface change can be correlated to a casing section, or part of a casing section. In a step 635, the contact position of the surface change and the casing section can be analyzed for parameters of the surface change, such as a wear volume, a wear length, or a direction of the wear (such as radial wear, axial wear, angled wear, circular or swirl type wearing, or other wear directions). The contact position on the casing section can be updated with the estimated wear that has occurred at that position of the casing section. This information can be used to generate the casing wear parameter for this section of casing.

In a decision step 640, a determination can be made whether all relevant sections of drilling pipe have been analyzed, or if additional sections of drilling pipe should be analyzed. If the decision is that there are additional sections of drilling pipe to analyze, then method 600 follows the "No" path to step 615 and the next section of drilling pipe is analyzed. If there are no more relevant sections of drilling pipe to analyze, then the "Yes" path is followed to a step 645. Method 600 ends at step 645.

Figure 7:
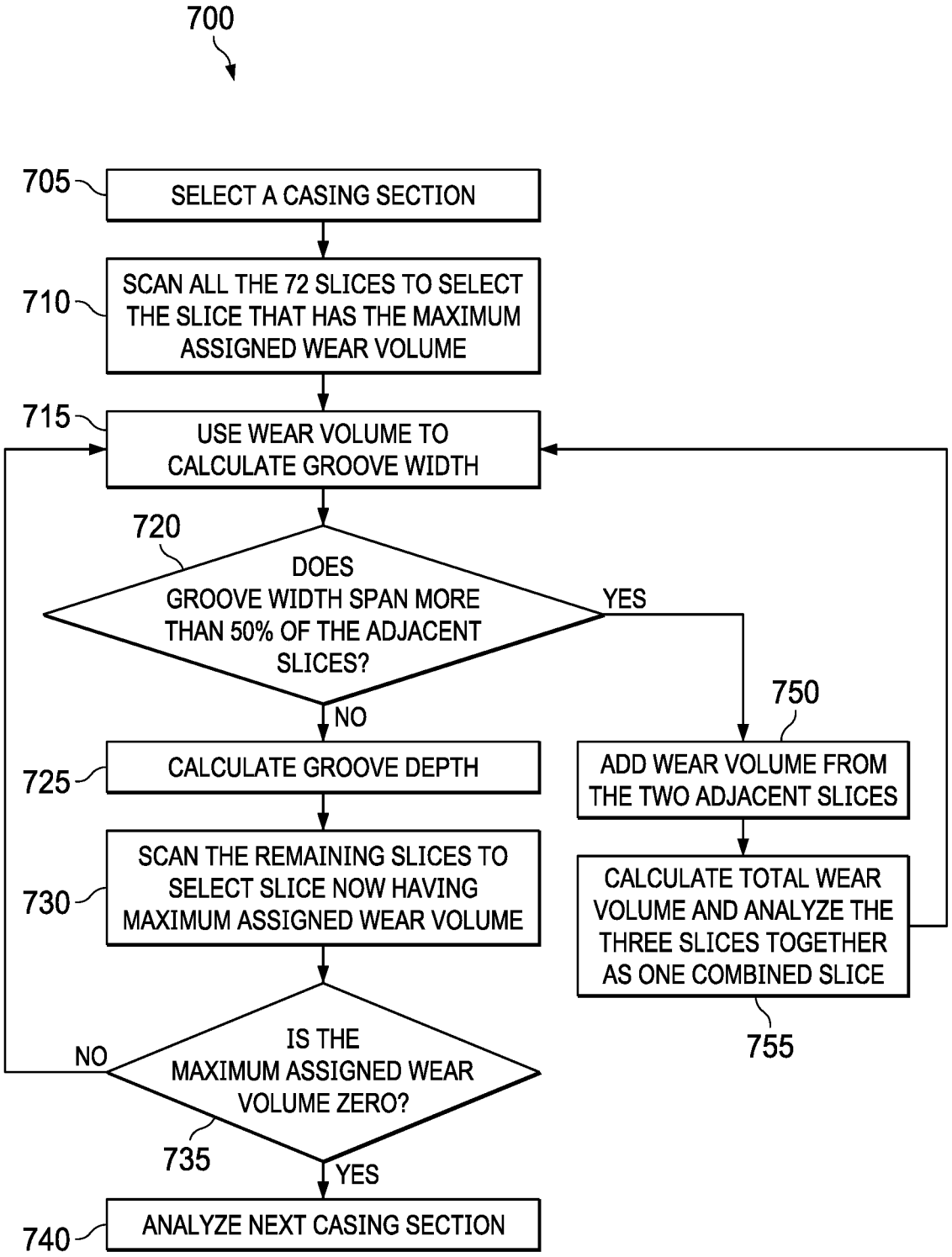
FIG. 7 is an illustration of a flow diagram of an example method to analyze a surface change in a drilling pipe.

FIG. 7 is an illustration of a flow diagram of an example method 700 to analyze a surface change in a drilling pipe. Method 700 starts at a step 705 where a section of drilling pipe is selected to be analyzed. In a step 710, the visual frames representing a 360-degree view of the surface of the section of drilling pipe can be decomposed into slices, for example 1/72 of the circumference. Other arc decomposition parameters can be utilized, for example, 1/60 or 1/120 of the circumference. Each of the decomposed visual frame slices can be analyzed to determine the section with the maximum wear volume.

Proceeding a step 715, the maximum wear volume can be used to calculate the groove width. In a decision step 720, a determination can be made on whether the groove width spans more than 50% of one or more adjacent slices. If the resultant is "Yes", then method 700 proceeds to a step 750. If the resultant is "No", then method 700 proceeds to a step 725.

In step 725, the depth of the groove can be calculated. In a step 730, the remaining slices can be scanned and the slice having the next maximum wear volume can be selected. In a decision step 735, a determination can be made whether the maximum wear volume is zero or within a specified limit of zero. If the resultant is "No", method 700 proceeds to step 715. If the resultant is "Yes", method 700 proceeds to a step 740. In step 740, the next section of drilling pipe can be analyzed. If there are no more sections of the drilling pipe to analyze, method 700 ends.

In step 750, the wear volume from the original slice and the neighboring slice can be added. In a step 755, a total wear volume can be calculated. The slices contributing to the wear volume can be analyzed together as a combined slice. One wear type classification can be identified, and one casing wear parameter can be determined. Method 700 proceeds to step 715.

Functional flow 400, functional flow 500, method 600, and method 700 can be performed on a computing system, such as a well site controller, a drilling controller, a geosteering system, a BHA, an edge computing system, or other computing system capable of receiving the various survey parameters and inputs, and capable of communicating with equipment or a user at a borehole site. Other computing systems can be a smartphone, PDA, laptop computer, desktop computer, server, data center, cloud environment, or other computing system. These functional flows and methods can be encapsulated in software code or in hardware, for example, an application, code library, dynamic link library, module, function, RAM, ROM, and other software and hardware implementations. The software can be stored in a file, database, or other computing system storage mechanism.

The functional flows and methods can be partially implemented in software and partially in hardware. The functional flows and methods can perform the operations within the computing system or, in some aspects, generate a visual component, for example, a chart or graph showing the casing wear at one or more depths in the borehole. The functional flows and methods can be performed partially or wholly by casing wear modeler system 800 of FIG. 8 or visual analysis controller 900 of FIG. 9. In some aspects, each function or method step can be one or more microservices. In some aspects, a microservice can have one or more functions or method steps. Each microservice can be encapsulated as a software component, a hardware component, or a combination thereof.

Figure 8:
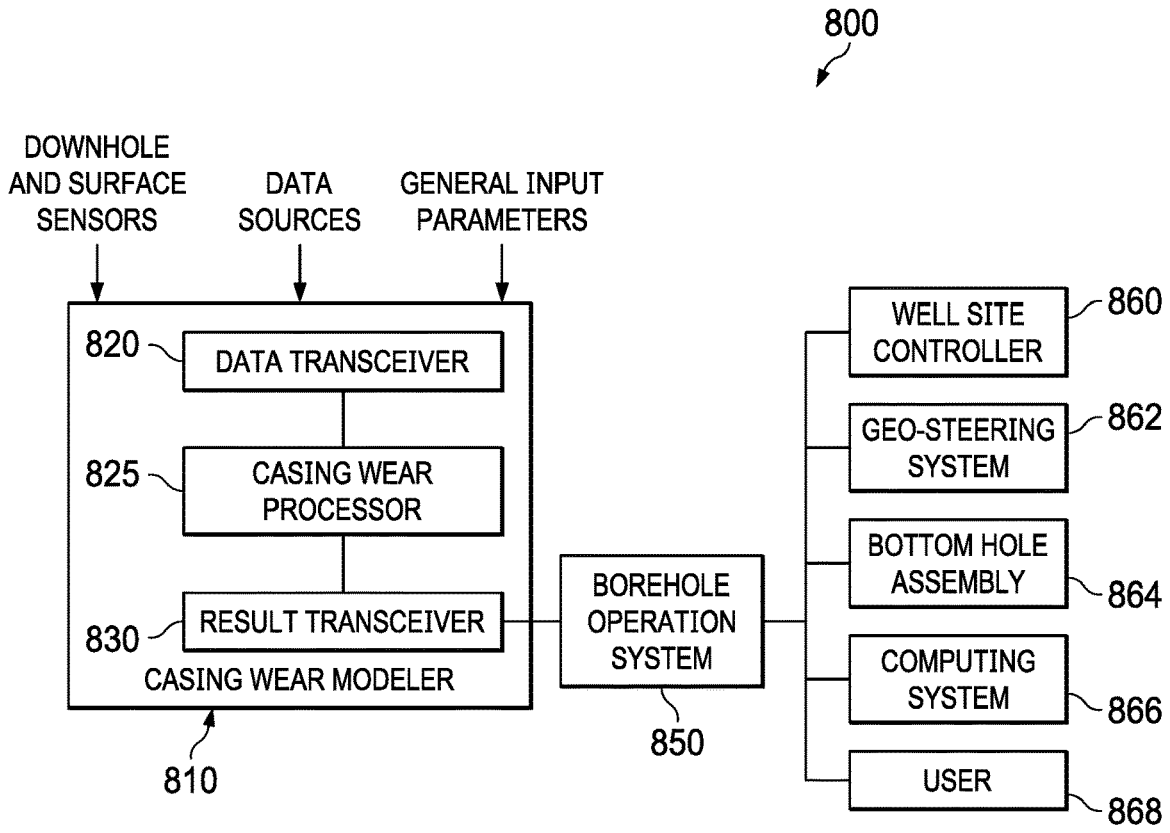
FIG. 8 is an illustration of a block diagram of an example casing wear modeler system.

FIG. 8 is an illustration of a block diagram of an example casing wear modeler system 800, which can be implemented in one or more computing systems, for example, a well site controller, a reservoir controller, a drilling controller, a data center, cloud environment, server, laptop, smartphone, tablet, an edge computing system, and other computing systems. The computing system can be located downhole, proximate the well site, or a distance from the well site, such as in a data center, cloud environment, or corporate location. Casing wear modeler system 800 can be implemented as an application, a code library, a dynamic link library, a function, microservice, module, other software implementation, or combinations thereof. In some aspects, casing wear modeler system 800 can be implemented in hardware, such as a ROM, a graphics processing unit, or other hardware implementation. In some aspects, casing wear modeler system 800 can be implemented partially as a software application and partially as a hardware implementation. In some aspects, casing wear modeler system 800 can be implemented wholly or partially by visual analysis controller 900 of FIG. 9.

Casing wear modeler system 800 includes a casing wear modeler 810 which further includes a data transceiver 820, a casing wear processor 825, and a result transceiver 830. Data transceiver 820 can receive input parameters (such as downhole parameters on the conditions within the borehole, the composition of the mud, surface parameters, for example, visual frames, and other input parameters, for example, a surface threshold parameter), sensor data from one or more downhole sensors or surface sensors (such as temperature parameters or pressure parameters), input parameters from previous collected data (such as visual frames captured when the drill string was inserted into the borehole), and input parameters from a data store (such as laboratory test results or previously generated casing wear models). Data transceiver 820 is capable of receiving input parameters for one or more portions of the borehole (such as at one or more depths or ranges of depths).

The input parameters can include parameters, instructions, directions, data, and other information to enable or direct the remaining processing of casing wear modeler system 800. The data store can be one or more data stores, such as a database, a data file, a memory, a server, a laptop, a server, a data center, a cloud environment, or other types of data stores located proximate casing wear modeler 810 or distant from casing wear modeler 810.

Data transceiver 820 can receive the data and parameters from one or more sensors located proximate the drilling system or located elsewhere in the borehole or at a surface location. In some aspects, data transceiver 820 can receive various data from a computing system, for example, when a controller or computing system collects the data from the sensors and then communicates the data to data transceiver 820. The measurements collected by the sensors can be transformed into input parameters by the sensors, data transceiver 820, or another computing system.

Result transceiver 830 can communicate one or more calculated results, e.g., casing wear parameters, to one or more other systems, such as a geo-steering system, a geo-steering controller, a well site controller, a drilling controller, a rig controller, a computing system, a BHA, a drilling system, a user, or other borehole related systems. Other borehole related systems can include a computing system where casing wear modeler 810 is executing or be located in another computing system proximate or distant from casing modeler 810. Data transceiver 820 and result transceiver 830 can be, or can include, conventional interfaces configured for transmitting and receiving data. In some aspects, data transceiver 820 and result transceiver 830 can be combined into one transceiver. In some aspects, data transceiver 820, casing wear processor 825, and result transceiver 830 can be combined into one component. In some aspects, data transceiver 820 and result transceiver 830 can be implemented using communications interface 910 of FIG. 9.

Casing wear processor 825 can implement the methods, processes, analysis, and algorithms as described herein utilizing the received data and input parameters, or at least some of the received data and input parameters, to determine, in some aspects, a casing wear parameter, to be used for a casing wear analysis. In some aspects, casing wear processor 825 can determine adjusted input parameters using an output from a machine learning system or deep neural network system. In some aspects, the machine learning system can be used to generate the casing wear parameter. In some aspects, casing wear processor 825 can use one or more algorithms and systems, such as a machine learning system, a deep neural network system, a decision tree algorithm, a random forest algorithm, a logistic regression algorithm, a linear algorithm, a stochastic algorithm, and other statistical algorithms. In some aspects, casing wear processor 825 can utilize a weight distribution model to ascertain the casing wear parameter when one or more of the input parameters are uncertain or estimated.

Figure 9:
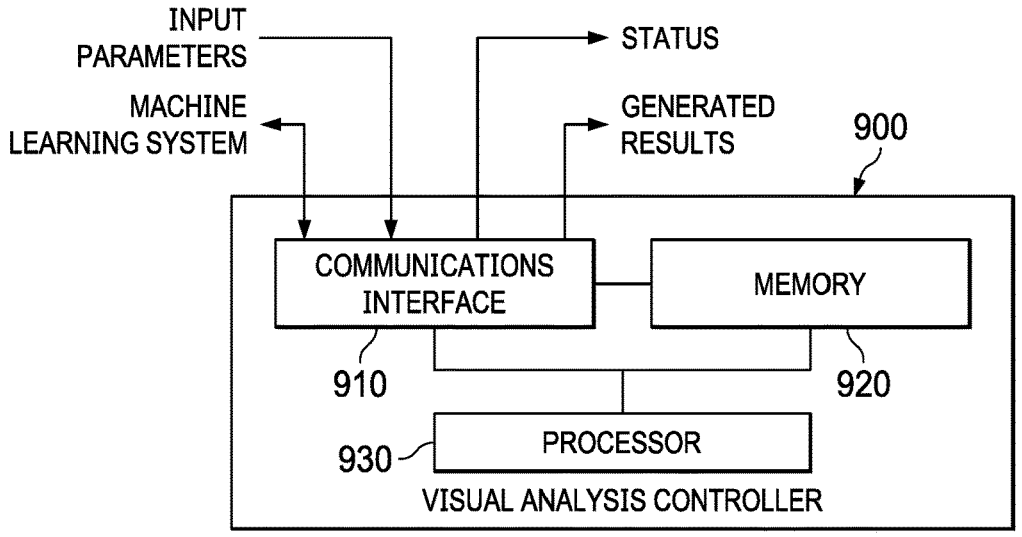
FIG. 9 is an illustration of a block diagram of an example of a visual analysis controller according to the principles of the disclosure.

In some aspects, casing wear processor 825 can be implemented using instructions and data utilizing processor 930 of FIG. 9. In some aspects, casing wear processor 825 can implement one or more of the functions described in functional flow 400 of FIG. 4, functional flow 500 of FIG. 5, method 600 of FIG. 6, or method 700 of FIG. 7. A memory or data storage of casing wear processor 825 or casing wear modeler 810 can be configured to store the processes and algorithms for directing the operation of casing wear processor 825.

The results from casing wear modeler 810 can be communicated to another system, such as a borehole operation system 850. Borehole operation system 850 can be one or more of a controller 860 (such as a well site controller, a drilling controller, or another controller), a geo-steering system 862, a BHA 864, a computing system 866, or a user 868. In aspects where user 868 receives the results, the results can include a visualization of the results to assist the user in further decision making. The results can be used to direct the borehole operation system 850 by indicating the estimated amount of casing wear for a section of casing located downhole, or performing other remediation operations.

FIG. 9 is an illustration of a block diagram of an example of visual analysis controller 900 according to the principles of the disclosure. Visual analysis controller 900 can be stored on a single computer or on multiple computers. The various components of visual analysis controller 900 can communicate via wireless or wired conventional connections. A portion or a whole of visual analysis controller 900 can be located downhole at one or more locations and other portions of visual analysis controller 900 can be located on a computing device or devices located at the surface or a distant location from the borehole. In some aspects, visual analysis controller 900 can be wholly located at a surface or distant location. In some aspects, visual analysis controller 900 is part of a geo-steering system, and can be integrated in a single device. In some aspects, visual analysis controller 900 can be an edge computing system.

Visual analysis controller 900 can be configured to perform the various functions disclosed herein including receiving input parameters and generating results, such as the casing wear parameter, from an execution of the methods and processes described herein. In some aspects, visual analysis controller 900 can implement one or more of the functions described in functional flow 400 of FIG. 4, functional flow 500 of FIG. 5, method 600 of FIG. 6, or method 700 of FIG. 7. Visual analysis controller 900 includes a communications interface 910, a memory 920, and a processor 930.

Communications interface 910 is configured to transmit and receive data. For example, communications interface 910 can receive the input parameters. Communications interface 910 can transmit the casing wear parameter, visual frames, and interim analysis results, and other generated results. In some aspects, communications interface 910 can transmit a status, such as a success or failure indicator of visual analysis controller 900 regarding receiving the input parameters, transmitting the generated results, or producing the generated results. In some aspects, communications interface 910 can receive input parameters from a machine learning system, such as when the input parameters are pre-processed by a machine learning system or a deep neural network system prior to being utilized as an input into the described processes and methods. In some aspects, the machine learning system can be used to process the input parameters and to generate the casing wear parameters using modeling techniques. Communications interface 910 can communicate via communication systems used in the industry. For example, wireless or wired protocols can be used. Communication interface 910 is capable of performing the operations as described for data transceiver 820 and result transceiver 830.

Memory 920 can be configured to store a series of operating instructions that direct the operation of processor 930 when initiated, including the code representing the algorithms for analyzing the received visual frames, as well as data, parameters, and other information. Memory 920 is a non-transitory computer readable medium. Multiple types of memory can be used for data storage and memory 920 can be distributed.

Processor 930 can be configured to produce the generated results, including the casing wear parameter, and statuses utilizing the received input parameters, and, if provided, the machine learning system or deep neural network system inputs. For example, processor 930 can perform an analysis of the input parameters and determine an amount of casing wear. Processor 930 can be configured to direct the operation of visual analysis controller 900. Processor 930 includes the logic to communicate with communications interface 910 and memory 920, and perform the functions described herein. Processor 930 is capable of performing or directing the operations as described by casing wear processor 825.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions, and modifications may be made to the described embodiments. It is also to be understood that the terminology used herein is for the purpose of describing particular embodiments only, and is not intended to be limiting, since the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

Each aspect as stated in the SUMMARY can have one or more of the following additional elements in combination. Element 1: communicating the casing wear parameter to a well site controller, a drilling controller, a rig controller, or a user. Element 2: adjusting a drilling operation of the borehole using the casing wear parameter. Element 3: initiating a casing wear remediation utilizing the casing wear parameter. Element 4: producing a visualization of the casing wear parameter. Element 5: wherein the at least one visual frame is a first visual frame, and the analyzing utilizes a second visual frame taken when the drilling pipe was previously inserted into the borehole to determine the surface change. Element 6: wherein the at least one visual frame provides a 360-degree view of the surface of the drilling pipe. Element 7: wherein the 360-degree view is divided into 72 slices and the analyzing uses the 72 slices as the at least one visual frame. Element 8: wherein the analyzing scans an adjacent slice of each slice in the 72 slices to determine the surface change. Element 9: wherein the correlating utilizes one or more casing wear models to determine the casing wear parameter. Element 10: wherein the analyzing utilizes an autoregressive model to determine the surface change. Element 11: wherein the analyzing utilizes a one-dimensional model and a surface threshold parameter to determine a roughness of the surface of the first drilling pipe segment. Element 12: wherein the analyzing utilizes simulated images to classify surface textures. Element 13: wherein the correlating calculates a side force or a metal wear to determine the casing wear parameter. Element 14: wherein the casing wear parameter includes a wear classification. Element 15: wherein the receiving, the determining, the analyzing, and the correlating are repeated for a second drilling pipe segment. Element 16: transforming the input parameters utilizing a machine learning system or a deep neural network system. Element 17: wherein at least one of the receiving, the determining, the analyzing, or the correlating is encapsulated as a function or a microservice accessible by other functions or microservices. Element 18: wherein a drilling controller or a well site controller is capable of receiving the casing wear parameter and of initiating a remediation operation utilizing the casing wear parameter. Element 19: wherein the data transceiver, the result transceiver, and the casing wear processor is part of one or more of a well site controller, a drilling controller, a geo-steering system, a bottom hole assembly, or a computing system. Element 20: wherein the casing wear parameter further comprises a visualization of the casing wear parameter, and a user initiates a remediation utilizing the casing wear parameter. Element 21: wherein the casing wear processor is capable of utilizing a machine learning system or a deep neural network system to transform the input parameters. Element 22: wherein the input parameters are trip out input parameters, and the data transceiver receives trip in input parameters at a time when the drill string is being inserted into the borehole, and the casing wear processor is capable of comparing the trip in input parameters and the trip out input parameters. Element 23: wherein the casing wear processor can utilize one or more functions or microservices.

What is claimed is:

1. A method, comprising:

receiving input parameters at a casing wear processor that include downhole conditions of a borehole and at least one visual frame representing a digital image of a first drilling pipe segment of a drill pipe undergoing a trip out operation from the borehole subsequent to a drilling job, wherein the at least one visual frame is captured at a surface location of the borehole and a device capturing the visual frame is not in contact with the first drill pipe segment;

determining a depth range of the first drilling pipe segment, wherein the depth range corresponds to a location of the first drilling pipe segment in the borehole during the drilling job;

determining a surface change of a surface of the first drilling pipe segment by analyzing the at least one visual frame;

identifying a section of casing located downhole in the borehole, that was in contact with the first drilling pipe segment, utilizing the depth range;

determining a casing wear parameter by correlating the surface change to the section of casing utilizing the downhole conditions, a wear classification, and a metal wear of the first drilling pipe segment; and replacing the section of casing or modifying a borehole operation of the borehole utilizing the casing wear parameter by using one or more of adjusting a weight-on-bit, a drill string rotation rate, a drill string size, a mud density, a mud rheology, a mud velocity, or a pipe eccentricity.

2. The method as recited in claim 1, further comprising: communicating the casing wear parameter to a well site controller, a drilling controller, a rig controller, or a user.

3. The method as recited in claim 1, further comprising: initiating a casing wear remediation utilizing the casing wear parameter.

4. The method as recited in claim 1, further comprising: producing a visualization of the casing wear parameter.

5. The method as recited in claim 1, wherein the at least one visual frame is a first visual frame, and the analyzing utilizes a second visual frame taken when the drilling pipe was previously inserted into the borehole to determine the surface change.

6. The method as recited in claim 1, wherein the at least one visual frame provides a 360-degree view of the surface of the drilling pipe.

7. The method as recited in claim 6, wherein the 360-degree view is divided into 72 slices and the analyzing uses the 72 slices as the at least one visual frame.

8. The method as recited in claim 7, wherein the analyzing the at least one visual frame scans an adjacent slice of each slice in the 72 slices to determine the surface change.

9. The method as recited in claim 1, wherein the determining the casing wear parameter utilizes one or more casing wear models to determine the casing wear parameter.

10. The method as recited in claim 1, wherein the determining the surface change analyzing utilizes an autoregressive model to determine the surface change.

11. The method as recited in claim 1, wherein the determining the surface change utilizes a one-dimensional model and a surface threshold parameter to determine a roughness of the surface of the first drilling pipe segment.

12. The method as recited in claim 1, wherein the determining the surface change utilizes simulated images to classify surface textures.

13. The method as recited in claim 1, wherein the casing wear parameter is one or more of a depth parameter, a type of wear, a severity of the wear, or a classification of the wear.

14. The method as recited in claim 1, wherein the casing wear parameter includes a wear classification, and the wear classification is at least one of a chemical classification, a scratching classification, a pitting classification, a rubbing classification, an impacting classification, a grooving classification, or a gouging classification.

15. The method as recited in claim 1, wherein the receiving, the determining the depth range, the determining the surface change, the identifying the section of casing, and the determining the casing wear parameter are repeated for a second drilling pipe segment.

16. The method as recited in claim 1, further comprising:

transforming the input parameters utilizing a machine learning system or a deep neural network system.

17. The method as recited in claim 1, wherein at least one of the receiving, the determining the depth range, the determining the surface change, the identifying the section of casing, or the determining the casing wear parameter is encapsulated as a function or a microservice accessible by other functions or microservices.

18. A system, comprising:

a data transceiver, capable of receiving input parameters including downhole conditions and at least one visual frame of a drill string, wherein the at least one visual frame is received from one or more image devices located at a surface location of a borehole undergoing a drilling operation, where the one or more image devices are not in contact with the drill string, the drill string is coupled to a surface equipment of the borehole, and the drill string is undergoing a trip in operation or a trip out operation at the borehole;

a result transceiver, capable of communicating a casing wear parameter; and a casing wear processor, capable of using the input parameters to generate the casing wear parameter by calculating a metal wear on a section of casing, wherein each visual frame is analyzed by the processor for a surface change in a surface of the drill string, where the metal wear is determined utilizing the surface change, the section of casing is identified by correlating the drill string location in the borehole during an active drilling portion of the drilling operation and the drill string was in contact with the section of casing, the casing wear parameter is determined by correlating the surface change of the drill string to the section of casing, and the casing wear parameter is used to replace the section of casing or to modify a weight-on-bit, a drill string rotation rate, a drill string size, a mud density, a mud rheology, a mud velocity, or a pipe eccentricity.

19. The system as recited in claim 18, wherein a drilling controller or a well site controller is capable of receiving the casing wear parameter and of initiating the remediation utilizing the casing wear parameter.

20. The system as recited in claim 18, wherein the data transceiver, the result transceiver, and the casing wear processor are part of one or more of a well site controller, a drilling controller, a geo-steering system, a bottom hole assembly, or a computing system.

21. The system as recited in claim 18, wherein the casing wear parameter further comprises a visualization of the casing wear parameter, and a user initiates a remediation utilizing the casing wear parameter.

22. The system as recited in claim 18, wherein the casing wear processor is capable of utilizing a machine learning system or a deep neural network system to transform the input parameters.

23. The system as recited in claim 18, wherein the input parameters are trip out input parameters, and the data transceiver receives trip in input parameters, where the trip in input parameters were captured at a previous time when the drill string was inserted into the borehole, and the casing wear processor is capable of comparing the trip in input parameters and the trip out input parameters.

24. The system as recited in claim 18, wherein the casing wear processor utilizes one or more functions or microservices.

25. A computer program product having a series of operating instructions stored on a non-transitory computer-readable medium that directs a data processing apparatus when executed thereby to perform operations, the operations comprising:

receiving input parameters at a casing wear processor that include downhole conditions of a borehole and at least one visual frame representing a digital image of a first drilling pipe segment of a drill pipe undergoing a trip out operation from the borehole subsequent to a drilling job, wherein the at least one visual frame is captured at a surface location of the borehole and a device capturing the visual frame is not in contact with the first drill pipe segment;

determining a depth range of the first drilling pipe segment, wherein the depth range corresponds to a location of the first drilling pipe segment in the borehole during the drilling job;

determining a surface change of a surface of the first drilling pipe segment by analyzing the at least one visual frame;

identifying a section of casing located in the borehole, that was in contact with the first drilling pipe segment, utilizing the depth range;

determining a casing wear parameter by correlating the surface change to the section of casing utilizing the downhole conditions, a wear classification of the surface change, and a metal wear of the first drilling pipe segment determined using the surface change; and replacing the section of casing or modifying at least one borehole operation of the borehole utilizing the casing wear parameter by using one or more of adjusting a weight-on-bit, a drill string rotation rate, a drill string size, a mud density, a mud rheology, a mud velocity, or a pipe eccentricity.

* * * * *